US006520758B1

(12) United States Patent
Sowards

(10) Patent No.: US 6,520,758 B1
(45) Date of Patent: Feb. 18, 2003

(54) SCREW COMPRESSOR ASSEMBLY AND METHOD INCLUDING A ROTOR HAVING A THRUST PISTON

(75) Inventor: Brian David Sowards, Mooresville, NC (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 10/040,081

(22) Filed: Oct. 24, 2001

(51) Int. Cl.[7] ..... F04C 18/16; F04C 29/08

(52) U.S. Cl. ..... 418/203; 418/1; 418/97; 418/98; 418/201.2

(58) Field of Search ..... 418/1, 87, 97, 418/98, 201.1, 201.2, 203; 415/104, 105

(56) References Cited

U.S. PATENT DOCUMENTS

| | | | | |
|---|---|---|---|---|
| 1,620,261 A | | 3/1927 | Kennedy | |
| 2,077,394 A | | 4/1937 | Buenger | |
| 2,287,716 A | * | 6/1942 | Whitfield | 418/201.1 |
| 2,654,532 A | | 10/1953 | Nichols | |
| 3,243,103 A | | 3/1966 | Bellmer | |
| 3,275,226 A | | 9/1966 | Whitfield | |
| 3,388,854 A | | 6/1968 | Olofsson et al. | |
| 3,448,916 A | | 6/1969 | Fraser | |
| 3,542,497 A | | 11/1970 | Chapuis | 418/84 |
| 3,811,805 A | | 5/1974 | Moody, Jr. et al. | 418/203 |
| 3,867,076 A | * | 2/1975 | Spindler | 418/201.1 |
| 3,905,729 A | | 9/1975 | Bauer | 418/87 |
| 3,932,073 A | | 1/1976 | Schibbye et al. | 418/203 |
| 3,936,239 A | | 2/1976 | Shaw | 418/201.2 |
| 3,947,078 A | | 3/1976 | Olsaker | 418/203 |
| 4,017,223 A | | 4/1977 | Blackwell | 418/203 |
| 4,035,114 A | | 7/1977 | Sato | 418/87 |
| 4,173,440 A | | 11/1979 | Libis | 418/84 |
| 4,180,089 A | | 12/1979 | Webb | 418/203 |
| 4,394,113 A | | 7/1983 | Bammert | 418/98 |
| 4,439,121 A | | 3/1984 | Shaw | 418/98 |
| 4,443,170 A | | 4/1984 | Schibbye et al. | 418/203 |
| 4,478,054 A | | 10/1984 | Shaw et al. | 418/98 |
| RE32,055 E | | 12/1985 | Schibbye et al. | 418/203 |
| 4,597,726 A | | 7/1986 | Soderlund et al. | 418/201.2 |
| 4,964,790 A | | 10/1990 | Scott | 418/203 |
| 5,135,374 A | | 8/1992 | Yoshimura et al. | 418/203 |
| 5,201,648 A | | 4/1993 | Lakowske | 418/201.2 |
| 5,207,568 A | | 5/1993 | Szymaszek | 418/203 |
| 5,211,026 A | | 5/1993 | Linnert | 418/201.2 |
| 5,246,357 A | | 9/1993 | Sjoholm et al. | 418/201.1 |
| 5,678,987 A | | 10/1997 | Timuska | 418/203 |
| 5,727,936 A | | 3/1998 | Eriksson et al. | 418/98 |

FOREIGN PATENT DOCUMENTS

| | | | | |
|---|---|---|---|---|
| JP | 62-107285 | * | 5/1987 | 418/201.1 |

* cited by examiner

*Primary Examiner*—John J. Vrablik
(74) *Attorney, Agent, or Firm*—Michael Best & Friedrich LLP

(57) ABSTRACT

An air compressor assembly of the rotary screw type. The air compressor assembly comprises a housing having an inlet end and a discharge end. An internal working chamber extends within the housing and terminates in a discharge end face at the discharge end of the housing. At least one rotor is mounted for rotation and axial movement within the working chamber. The rotor has a discharge end surface having a step defined thereon. A thrust piston extends from the rotor and is positioned within a thrust piston chamber. A pressure source is associated with the thrust piston chamber and is controllable between a high pressure condition and a reduced pressure condition to control the position of the rotor relative to the discharge end face. A method of mounting a rotor with a desired end clearance is also provided.

20 Claims, 2 Drawing Sheets

SCREW COMPRESSOR ASSEMBLY AND METHOD INCLUDING A ROTOR HAVING A THRUST PISTON

BACKGROUND

The present invention relates to air compressors. More particularly, the present invention relates to an improved screw-type air compressor.

Rotary screw-type air compressors generally include a pair of complementary rotors mounted within an internal working chamber of the compressor housing. Each rotor has a shaft supported for rotational movement by a pair of opposed radial bearings. Air enters through an airend inlet and is compressed by the rotating rotors as it moves toward a discharge port at the discharge end of the chamber. The spacing between the end surfaces of the rotors and the discharge end face of the housing is referred to as the discharge end clearance. This discharge end clearance has a substantial effect on the performance of the compressor. Accordingly, it is desirable to precisely set and maintain an operating discharge end clearance of a given air compressor to achieve a desired performance.

Current methods of mounting the rotors with a desired operating end clearance generally require extensive, very precise machining of the rotors and the housings. Bearings must also be accurately manufactured to provide not only radial support, but also axial support. Even with precise machining, the desired end clearance is often not achieved without extensive assembly procedures, for example, precision measuring and calculating of relative housing and rotor assembly measurements and the inclusion of compensating components, including shim plates or like. In addition to precise machining and assembly, other factors, for example, the internal rotor gas forces, must also be calculated and compensated for.

SUMMARY

The present invention provides an air compressor assembly of the rotary screw type that provides accurate discharge end clearances with minimized manufacturing and assembly requirements. The air compressor assembly comprises a housing having an internal working chamber that extends within the housing and terminates in a discharge end face at the discharge end of the housing. At least one rotor is mounted for rotation and axial movement within the working chamber. The rotor has a discharge end surface having a step defined thereon. The step is preferably machined to a height precisely equal to the desired discharge end clearance. A thrust piston extends from the rotor and is positioned within a thrust piston chamber. A pressure source is associated with the thrust piston chamber and is controllable between a high pressure condition and a reduced pressure condition. In the high pressure condition, a high thrust pressure is created such that the thrust piston is moved axially toward the discharge end and the rotor step abuts the housing discharge end face to precisely position the rotor with the desired discharge end clearance. This condition is generally referred to as the "loaded" condition during which the airend generally delivers compressed air to the intended application. In the reduced pressure condition, the thrust pressure is reduced and the rotor step moves away from the discharge end face to allow the rotor to freewheel. This condition is generally referred to as the "unloaded" condition during which compressed air is not delivered to the intended application by the airend.

A method of mounting a rotor with a desired end clearance in accordance with the present invention is also provided.

DETAILED DESCRIPTION OF THE PREFERRED EMBODIMENTS

Figure 1:
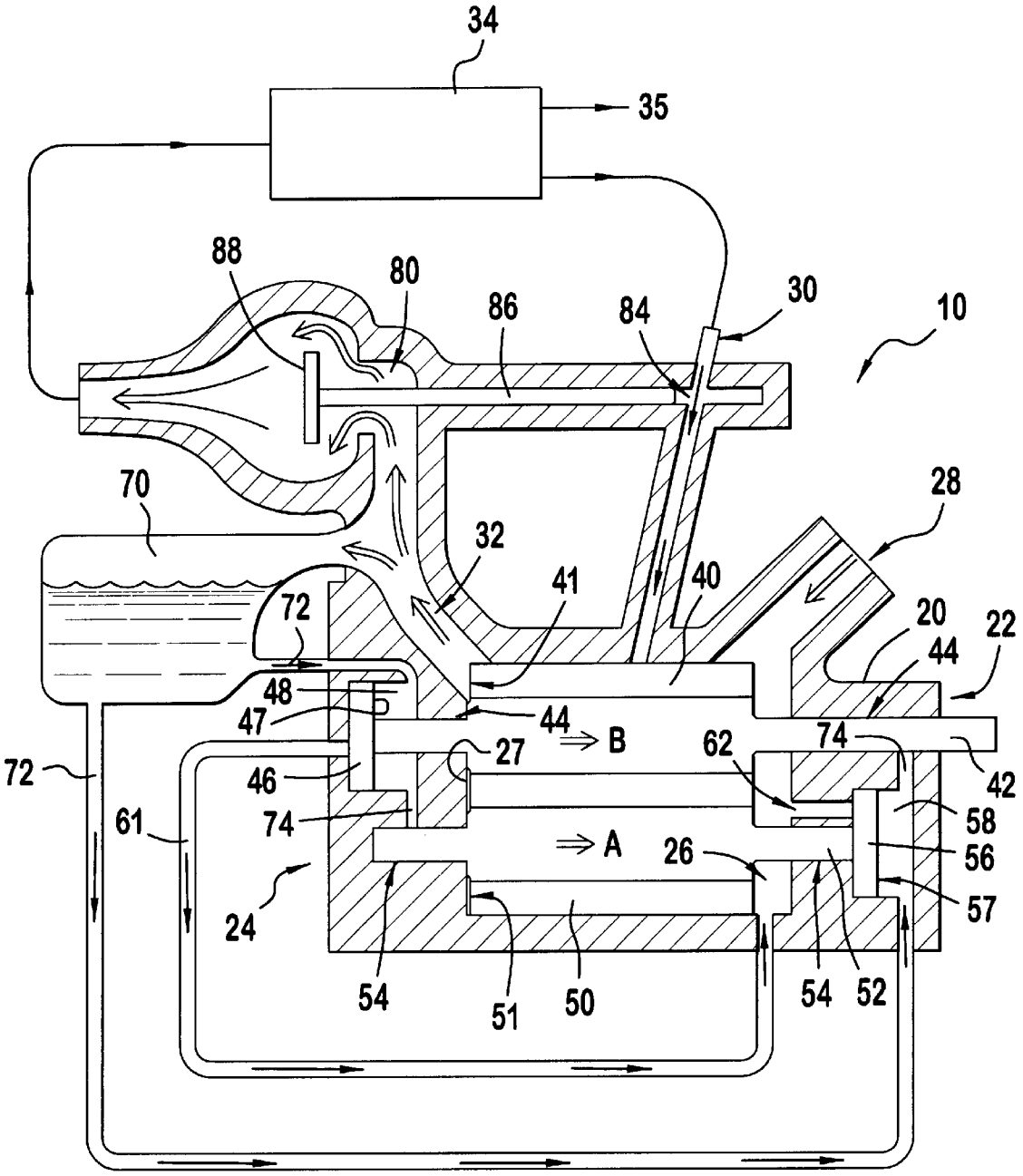
FIG. 1 is a schematic longitudinal cross-sectional elevation view of an air compressor assembly in accordance with a preferred embodiment of the present invention.

Referring to FIG. 1, an air compressor assembly 10 that is a preferred embodiment of the present invention is shown. The air compressor assembly 10 includes a housing 20 having an inlet end 22 and a discharge end 24. An internal working chamber 26 is defined between the ends 22 and 24 and terminates in a discharge end face 27 adjacent the discharge end 24. An airend inlet 28 and an oil inlet 30 extend into the working chamber 26 toward the inlet end 22 of the housing 20. A discharge port 32 exits the working chamber 26 adjacent the discharge end 24. The air/oil mixture exiting the discharge port 32 generally travels to a separation tank 34. Oil separated from the air/oil mixture is returned from the separation tank 34 to the air compressor assembly 10 via the oil inlet 30. The compressed air is delivered from the separator tank 34 via a conduit 35 to an intended application, for example, a pneumatic tool. The housing 20 may be cast, machined or the like and is preferably manufactured from aluminum, but may be manufactured from other materials, for example, cast iron.

Preferably, a pair of complementary rotors 40 and 50 are supported within the working chamber 26. While a pair of rotors 40, 50 is preferred, it is also contemplated that more or fewer rotors may also be utilized. Each rotor 40, 50 has a rotor shaft 42, 52 supported in a pair of radial bearings 44, 54 at opposite ends of the housing 20. The radial bearings 44, 54 are preferably hydrodynamic bearings, but other bearings, for example, rolling element bearings, may also be utilized. The radial bearings 44, 54 support the respective rotor shafts 42, 52 for rotation and axial movement. One of the rotor shafts 42 extends from the housing 20 and engages a drive mechanism (not shown) which provides the desired rotational movement of the rotors 40, 50.

One end of each rotor shaft 42, 52 terminates in a thrust piston 46, 56 positioned within a respective thrust piston chamber 48, 58. As illustrated in FIG. 1, the thrust chambers 48, 58 may be located at opposite ends of the housing 20. Such positioning allows the thrust pistons 46, 56 to have maximized diameters without interfering with one another. However, other configurations, including side by side thrust pistons may also be used. Each chamber 48, 58 is supplied with oil via an oil supply path 72 extending from an oil reservoir 70 adjacent the discharge end 24 of the housing 20. The oil reservoir 70 may be formed integral with the housing 20 or may be formed as a separate component. The oil supply path 72 enters each chamber 48, 58 such that oil at discharge pressure is supplied to the chamber 48, 58. Conduits 61, 62 vent the thrust chambers 48, 58 on the opposite sides of the thrust pistons 46, 56 to inlet pressure such that a net differential force is generated by each thrust piston 46, 56, thereby forcing the respective rotors 40, 50, toward the discharge end 24 of the housing 20. Each thrust piston 46, 56 has a pressure surface 47, 57 of sufficient area such that when the air compressor assembly 10 is in a loaded condition, the thrust force on each piston 46, 56 in the direction of the discharge end is greater than the opposing rotor gas forces A, B created by the rotating rotors 40, 50. The thrust forces thereby drive the respective rotors 40, 50 axially until each rotor discharge end 41, 51 abuts the housing discharge end face 27.

Figure 2:
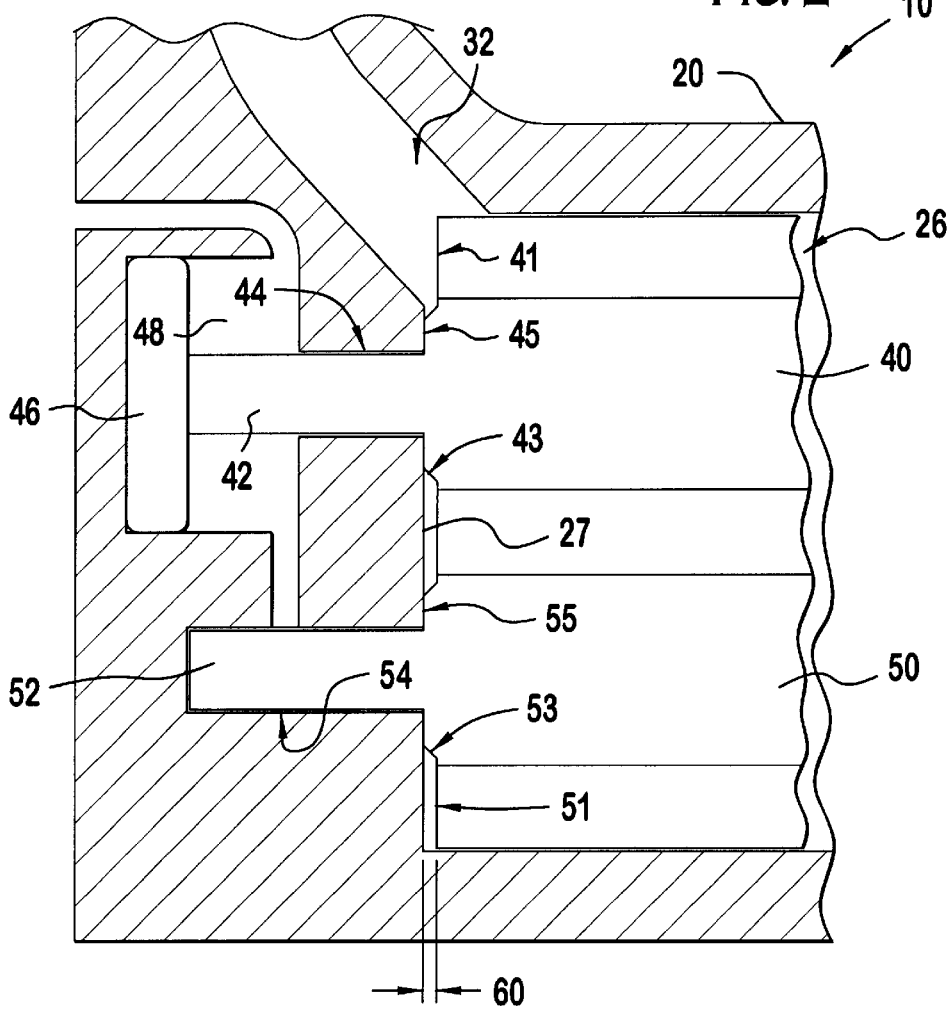
FIG. 2 is a partial, exploded view of the discharge end of the air compressor of FIG. 1.

Referring to FIG. 2, each rotor 40, 50 is formed with a step 43, 53 extending from its discharge end surface 41, 51. The steps 43, 53 are formed with a height equal to the desired discharge end clearance 60, the distance between the non-stepped portion of each rotor discharge end surface 41, 51 and the housing discharge end face 27. As such, the thrust pistons 46, 56 force the rotors 40, 50 axially until the steps 43, 53 contact the housing discharge end face 27, thereby accurately defining the desired discharge end clearance 60 for each rotor 40, 50. In addition to defining the discharge end clearance 60, the steps 43, 53 also define a thrust bearing surface of minimal area. That is, the diameter of each step 43, 53 is substantially less than the diameter of the respective rotor discharge end surface 41, 51. Oil flowing within the thrust piston chambers 48, 58 flows through the respective bearings 44, 54 and between the thrust faces 45, 55 and the discharge end face 27, forming a hydrodynamic thrust bearing having a minimized contact surface for each rotor 40, 50. While an aluminum housing 20 is preferred since it provides a proper bearing surface for faces 45, 55, the continuous oil coating allows for a wear free bearing even when other materials are used for the thrust surface.

Referring again to FIG. 1, by applying or relieving thrust piston pressure, the rotors 40, 50 move toward or away from the discharge end face 27 of the housing 20 and thereby either pump air (loaded condition) or freewheel (unloaded condition). To facilitate the changing conditions, the preferred compressor assembly 10 includes a discharge port check valve 80 and an oil stop valve 84. The discharge port check valve 80 is configured to close the discharge port passage 32 when the rotors 40, 50 are in the unloaded condition, thereby trapping the high pressure air in the separator tank 34 and allowing the rotors 40, 50 to freewheel at atmospheric pressure. Such unloading reduces the power requirement of the compressor assembly 10.

The oil stop valve 84 is configured to close the oil inlet 30 when the rotors 40, 50 are in the unloaded condition to prevent oil flooding in the working chamber 26. However, whether the compressor assembly 10 is operating in a loaded or unloaded condition, it is necessary to maintain oil flow in the rotor radial bearings 44, 54. While oil flow about the thrust bearings 45, 55 is beneficial, it is generally not required in the unloaded condition since the rotors 40, 50 move away from the housing discharge end face 27 as will be described in more detail hereinafter. The desired oil flow is provided by the oil reservoir 70. During loaded operation, the high pressure air/oil mixture passes out the discharge port 32 with oil filling the oil reservoir 70 and excess oil traveling with the air/oil mixture to the separator tank 34. The entrance to the oil reservoir 70 is preferably on the bottom of the discharge port 32 such that oil flowing through the discharge port 32 drains by gravity into the oil reservoir 70. Oil in the reservoir 70 travels through the oil supply paths 72 to the thrust piston chambers 48, 58. The oil entering each chamber 48, 58 flows to the radial bearing 44, 54 respectively adjacent the chamber 48, 58. Additionally, a secondary oil path 74 extends from each chamber 48, 58 to the adjacent bearing 44, 54 of the other rotor shaft 42, 52. That is, one secondary oil path 74 allows oil to flow from thrust piston chamber 58 to airend bearing 44 and the other secondary oil path 74 allows oil to flow from the thrust piston chamber 48 to the discharge end bearing 54. When the compressor assembly 10 is unloaded, the discharge port check valve 80 and the oil stop valve 84 close and the rotors 40, 50 freewheel at atmospheric pressure. Although the oil reservoir 70 is also at atmospheric pressure, it is located above the thrust piston chambers 48, 58 and bearings 44, 54 such that gravity causes the oil to flow to the chambers 48, 58 and bearings 44, 54. Oil passing through the bearings 44, 54 into the working chamber 26 is thrown toward the discharge port 32 by the rotating rotors 40, 50 such that it flows back into the reservoir 70 from where it can be recirculated.

Referring to FIG. 1, a preferred embodiment of the discharge port check valve 80 and the oil stop valve 84 is shown. The valves 80 and 84 are provided by a single rod 86 and valve head assembly 88. The valve head 88 is attached to the rod 86 which extends adjacent the discharge port 32 and the oil inlet 30. To close both valves 80 and 84, the rod 86 moves axially such that the rod 86 closes off the oil inlet 30 and the valve head 88 moves into the path of and closes off the discharge port 32. When the rotors 40, 50 are in the unloaded condition, the pressure in discharge port 32 is lower than the pressure in separator tank 34. As air tries to flow from the separator tank 34 back through the port 32, it forces the valve head 88 into the closed position. A spring or the like (not shown) may be provided to bias the rod 86 toward the closed position. Both valves 80 and 84 are held open in the loaded condition by air flow from the discharge port 32 forcing valve head 88 into the open position.

Having described the components of the preferred compressor assembly 10, its operation will be described with reference to FIGS. 1 and 2. Loading and unloading of the compressor assembly 10 is controlled by controlling the pressure in the thrust piston chambers 48 and 58. To unload the compressor assembly 10, the chambers 48 and 58 are vented to the inlet end 22 of the compressor housing 20. The pressure in the chambers 48, 58 is at atmospheric pressure, such that the rotor gas force A, B is greater than the thrust piston pressure whereby the rotors 40 and 50 move away from the discharge end face 27, thus increasing the discharge end clearance 60. Even though the discharge end clearance 60 is relatively large, the pressure at the discharge port 32 is greater than the inlet pressure. To load the compressor assembly 10, the vent lines to chambers 48 and 58 are closed and the higher discharge end pressure is applied to the oil reservoir 70, and in turn, to the chambers 48 and 58. The increase in pressure in the thrust chambers 48 and 58 increases the thrust forces which causes the rotors 40, 50 to begin to move axially toward the discharge end face 27, thereby decreasing the discharge end clearance 60. The reduced discharge end clearance 60 causes a greater discharge port pressure which increases the oil reservoir pressure, and in turn, the pressure in the chambers 48, 58. The process continues until the compressor assembly 10 is fully loaded with the steps 43 and 53 against the discharge end face 27, thereby precisely defining the desired discharge end clearance 60.

Figure 3:
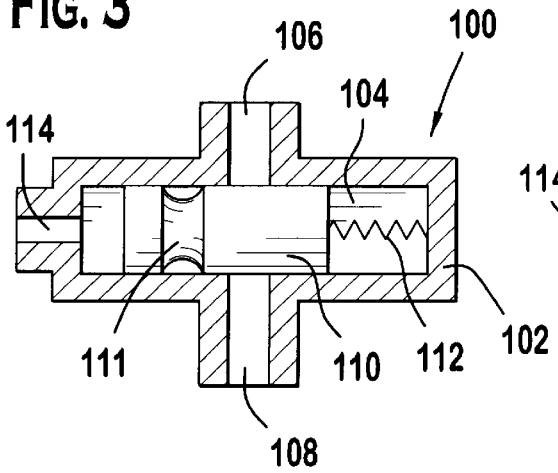
FIG. 3 is a longitudinal cross-sectional elevation view of a preferred thrust piston chamber valve of the present invention in the closed position.
Figure 4:
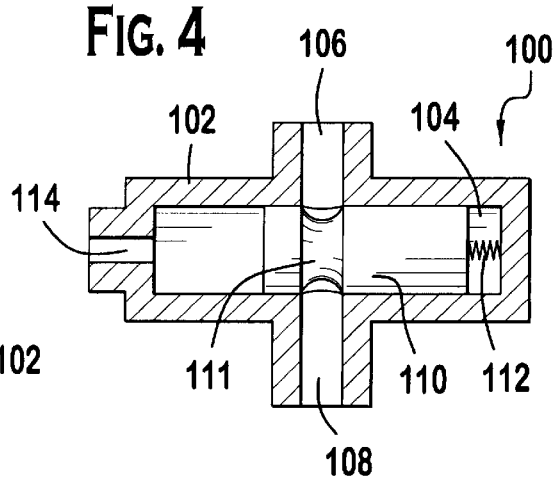
FIG. 4 is a longitudinal cross-sectional elevation view of the thrust piston chamber valve of FIG. 3 in the opened position.

A preferred valve assembly 100 utilized in venting the thrust piston chambers 48, 58 is shown in FIGS. 3 and 4. An individual valve assembly 100 may be utilized for each chamber 48, 58, or a common valve assembly may be utilized to simultaneously control both chambers 48, 58. The valve assembly 100 includes a valve housing 102 having an internal chamber 104. An inlet passage 106 from the thrust piston chamber 48, 58 extends into the valve chamber 104 in alignment with an outlet 108 from the chamber 104 to the compressor airend inlet 28. A spool member 110 including a passage area 111 is positioned in the chamber 104 between the inlet passage 106 and the outlet 108. The spool member 110 is axially moveable within the chamber 104 such that the passage area 111 can be aligned with (open) or offset from (closed) the inlet passage 106 and outlet 108. A spring 112 or the like biases the spool member 110 to the offset, closed position. A second inlet 114 from the separator tank enters the valve chamber 104 on the side of the spool member 110 opposite the spring 112. The spring 112 is selected such that it will prevent axial movement of the spool member 110 until the pressure in the separator tank 34 reaches a preselected value. Once the separator tank pressure reaches the preselected value, the spring force is overcome and the spool member 110 moves to the aligned, open position (see FIG. 4) whereby the thrust piston chamber 48, 58 vents to the airend inlet 28. With this configuration, the compressor assembly 10 can be controlled to store a desired pressure within the separator tank 34 and freewheel until the pressure is relieved by air utilization, at which time the valve 100 will close and the compressor assembly 10 will return to loaded operation.

What is claimed is:

1. An air compressor assembly comprising:

a housing having an inlet end and a discharge end;

an internal working chamber within the housing terminating in a discharge end face at the discharge end of the housing;

at least one rotor mounted for rotation and axial movement within the working chamber, the rotor having a discharge end having a step defined therein;

at least one thrust piston extending from the rotor with a portion of the thrust piston positioned within a first thrust piston chamber; and a pressure source associated with the thrust piston chamber and controllable between a high pressure condition wherein a high thrust pressure is created such that the thrust piston moves the rotor axially toward the discharge end face and the rotor step abuts the housing discharge end face and a reduced pressure condition wherein the thrust pressure is reduced and the rotor moves away from the discharge end face.

2. The air compressor assembly of claim 1 further comprising a second rotor having a discharge end having a step defined therein mounted within the working chamber.

3. The air compressor assembly of claim 2 wherein the second rotor has a second thrust piston associated therewith.

4. The air compressor assembly of claim 3 wherein a portion of the second thrust piston is positioned in a second thrust piston chamber, pressure in the second thrust piston chamber controllable between the high pressure condition and the reduced pressure condition.

5. The air compressor assembly of claim 4 wherein the first and second thrust piston chambers are positioned at opposite ends of the housing.

6. The air compressor assembly of claim 1 wherein the rotor is mounted in a pair of opposed bearings.

7. The air compressor assembly of claim 6 wherein the bearings are hydrodynamic bearings.

8. The air compressor assembly of claim 7 wherein one of the bearings is communicatingly associated with the thrust piston chamber such that an oil supply is provided from the thrust piston chamber to the bearing.

9. The air compressor assembly of claim 8 wherein the oil supply passes through the bearing and further lubricates the housing discharge end face.

10. The air compressor assembly of claim 1 further comprising an oil reservoir adjacent the discharge end of the housing such that an oil supply in the reservoir is at a pressure similar to that in the working chamber adjacent the discharge end of the housing.

11. The air compressor assembly of claim 10 wherein a first oil supply conduit extends from the oil reservoir to the thrust piston chamber.

12. The air compressor assembly of claim 11 wherein a first venting conduit extends from the thrust piston chamber to working chamber adjacent the inlet end of the housing.

13. The air compressor assembly of claim 12 wherein a control valve is positioned along the venting conduit to regulate the pressure in the thrust piston chamber.

14. The air compressor assembly of claim 1 wherein the housing includes a compressed air discharge port and an oil inlet.

15. The air compressor assembly of claim 14 further comprising a discharge port check valve and an oil inlet valve, both valves closing when the pressure source is in the reduced pressure condition.

16. The air compressor assembly of claim 1 wherein at least a portion of the discharge end face is manufactured from aluminum.

17. A method of mounting a rotor within an air compressor chamber with a desired discharge end clearance, the method comprising the steps of:

providing a housing having an inlet end and a discharge end with an internal working chamber therebetween, an internal discharge end face at the discharge end of the working chamber, and a thrust piston chamber;

providing a rotor having a discharge end surface with a step, having a depth equal to the desired discharge end clearance, extending therefrom;

mounting the rotor in the housing with the discharge end surface and step directed toward the housing discharge end face;

providing a thrust piston associated with the rotor and having a portion positionable in the thrust piston chamber; and controlling pressure in the thrust piston chamber between a high pressure condition wherein a high thrust pressure is created such that the thrust piston moves the rotor axially toward the discharge end and the rotor step abuts the housing discharge end face and a reduced pressure condition wherein the thrust pressure is reduced and the rotor moves away from the discharge end face.

18. The method of claim 17 further comprising the step of providing an oil conduit between the thrust piston chamber and an oil reservoir and a venting conduit between the thrust piston chamber and the working chamber adjacent the inlet end of the housing.

19. The method of claim 18 further comprising the step of providing a control valve along the venting conduit to control the pressure in the thrust piston chamber.

20. The method of claim 17 further comprising the step of providing a second rotor having a discharge end surface with a step therein.

* * * * *